United States Patent [19]

Sullivan et al.

[11] 4,049,164

[45] Sept. 20, 1977

[54] BACK FRAME

[75] Inventors: John L. Sullivan, Fort Erie, Canada; Veronica A. Knauber, Lancaster; James E. Nelson, Williamsville, both of N.Y.

[73] Assignee: A-T-O Inc., Willoughby, Ohio

[21] Appl. No.: 707,232

[22] Filed: July 21, 1976

[51] Int. Cl.[2] ..... A45F 3/00

[52] U.S. Cl. ..... 224/5 W; 224/25 A; 248/313

[58] Field of Search ..... 224/5 W, 25 A; 248/313, 248/231

[56] References Cited

U.S. PATENT DOCUMENTS

| | | | |
|---|---|---|---|
| 2,943,775 | 7/1960 | Mack | 224/5 W |
| 3,957,183 | 5/1976 | Gadberry | 224/5 W |

*Primary Examiner*—Albert J. Makay
*Attorney, Agent, or Firm*—Christel & Bean

[57] ABSTRACT

An improved back frame for supporting a tank of compressed breathing air in a life support breathing system wherein the back frame includes a harness for securing the frame to a user's back. The improvement resides in part in the provision of inclined lateral edge rails on the frame which are spaced outwardly from the user's back at the upper portion thereof and are oriented to incline or extend inwardly toward the user's back at the lower portion thereof. A retaining strap is slidably connected at each of its ends to the upper portion of a correspondingly associated edge rail. In this manner the strap may be slid along the rails to adjust the retention force imparted to a tank of compressed air mounted thereunderneath. In addition, the retaining strap includes at one end a stepped bracket connector for altering the nominal length of the strap while a toggle latch is provided at the opposite end thereof for loosening and tightening the strap with respect to a mounted air tank.

12 Claims, 10 Drawing Figures

20
34
28
32
38
8
50
8
30
50b
50a
48a
48
50a
42a
30
9
46
9
44
36
54c
54a
56
54
54b
54d 30
42
20
38
50
48a
50a
48

BACK FRAME

BACKGROUND OF THE INVENTION

This invention relates generally to life support breathing systems and the like, and more particularly, to a back frame therefor operable to support compressed breathing air tanks of various sizes. The back frame of the present invention provides a structure which is relatively simple to operate but which provides a high degree of safety and flexibility in use with respect to a predetermined range of various air tank sizes.

When a person must subsist in an atmosphere which is toxic, oxygen deficient or which for some other reason cannot support human life, he is equipped with a life support system comprising, for example, a breathing mask supplied with breathing air from a regulated source. His exhalation usually is exhausted to the ambient atmosphere. In particular, it is contemplated that the present invention be utilized by firefighters who are continually exposed to the aforesaid types of conditions.

Annually the number of materials which give off toxic products of combustion increases which in turn increases the hazards faced by firefighters. Accordingly, it is well recognized that firefighting is one of the most hazardous occupations in the United States. Even though the prior art provides apparatus for protection against such hazards however, it has been found that the level of respiratory injuries has been continuously rising.

Current breathing apparatus offers a level of protection from such hazards, but because such apparatus is heavy, bulky, and hard to don and wear, it is often not fully utilized by the working firefighter. It has been found that the discomfort and loss of mobility occasioned by firefighters using prior art apparatus is more significant than the protection which it provides in marginally dangerous situations.

In particular, a shortcoming of the prior art is to be found in not providing a lightweight, easy to operate and dependable back frame for supporting compressed breathing air tanks of varying diameters as are usually utilized in the life support systems considered herein. It is highly desirable that such air tanks, having limited supplies, may be quickly and securely exchanged when a life support system is in continuous, extended use. Necessarily, it is further desirable that these features exist for air tanks of different sizes all of which may be employed with the life support system.

SUMMARY OF THE INVENTION

Accordingly, one object of the present invention is to provide a new and improved back frame for supporting a tank of compressed breathing air in a life support system wherein the tank or a replacement therefor may be quickly mounted on the back frame with a high degree of assurance that the tank will remain in place during use.

Another object of the present invention is to provide the aforesaid improved back frame having a "fail-proof" latch for ensuring retention of a tank on the frame.

A further object of the present invention is to provide the aforesaid back frame with a retaining strap which is adjustable in regard to the degree of retention force applied to an air tank and in regard to its nominal length with respect to air tanks of different nominal sizes.

Still another object of the present invention is to provide the aforesaid improved back frame which is of lightweight and compact construction so as to minimize the discomfort and fatigue experienced by a user while maximizing his manueverability and efficiency, particularly with respect to firefighting applications.

In summary, the present invention provides a back frame for supporting a tank of compressed breathing air wherein the frame includes a pair of lateral edge rails spaced from the back of a user at the top portion thereof and being inclined so as to extend toward the back of the user at the bottom portion thereof. A retaining strap is mounted at each of its ends on the upper respective portions of the guide rails. The end connections of the retaining strap are slidable along the edge rails to vary the retention force applied to an air tank mounted thereunderneath, such variation in retention force resulting from the inclined nature of the edge rails. The retaining strap includes a one of its ends a stepped or multiple link connecting bracket whereby the effective length of the strap can be adjusted to accommodate tanks of various diameters. Furthermore, the other end of the strap includes a toggle latch for loosening and tightening the strap with respect to an air tank mounted on the frame. Accordingly, the relatively nominal and fine retention force adjustments provided respectively by the stepped bracket and inclined edge rails assures the firm engagement of an air tank against the frame while the toggle latch associated with the strap provides for ready exchange of the air tank. A U-shaped vertical support bracket is provided near the bottom of the back frame for vertical engagement with an apertured collar on the support tank.

The foregoing and other objects, advantages, and characterizing features of the present invention will become clearly apparent from the ensuring detailed description of an illustrative embodiment thereof, taken together with the accompanying drawings wherein like reference characters denote like parts throughout the various views.

DETAILED DESCRIPTION OF A PREFERRED EMBODIMENT

Figure 1:
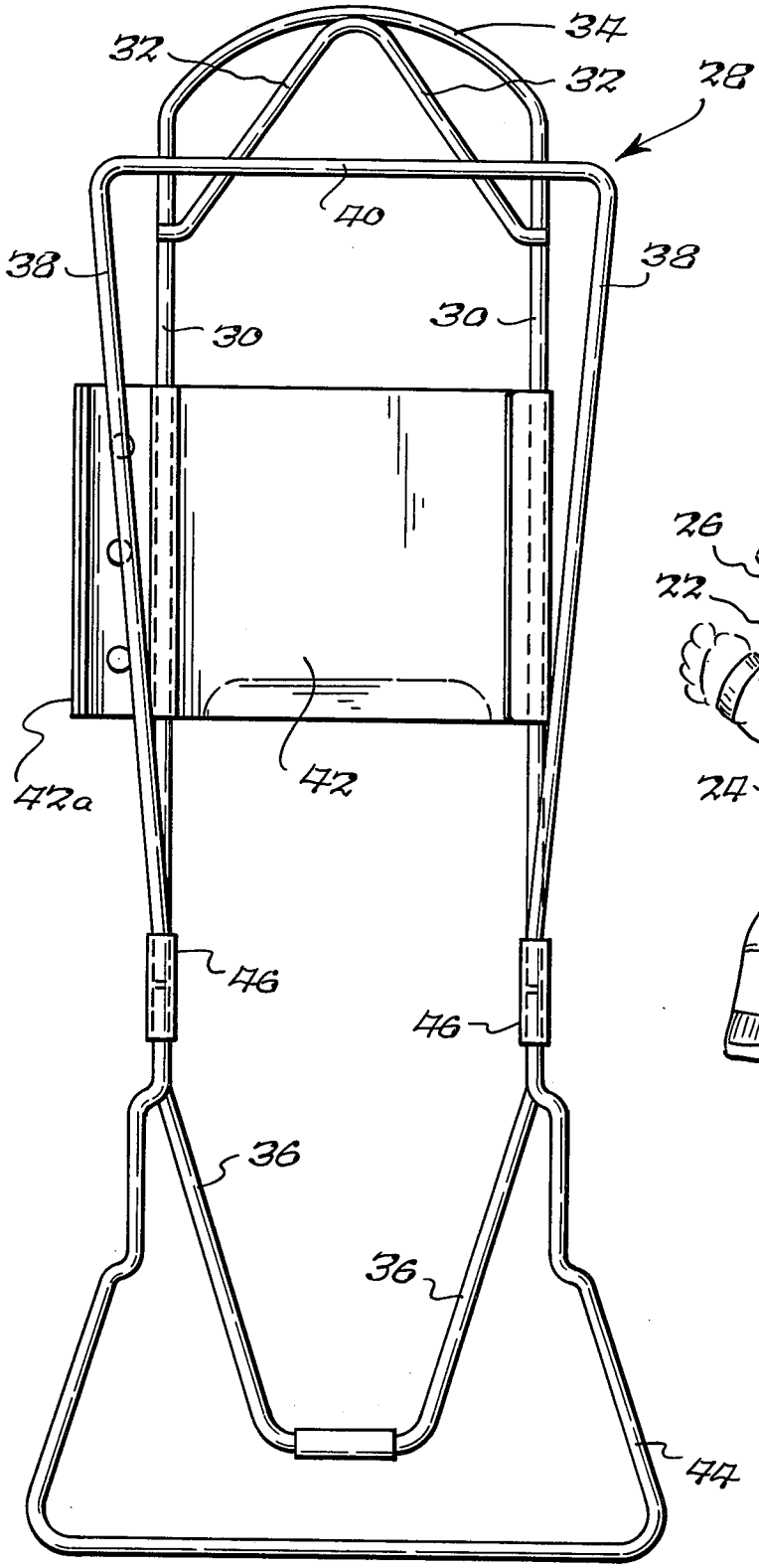
FIG. 1 is a pictorial illustration representing a life support breathing system as utilized by a firefighter.

Referring now in detail to the illustrative embodiment depicted in the accompanying drawings, there is shown in FIG. 1 a life support breathing system as used in firefighting applications utilizing the back frame of the present invention for supporting a tank 20 of compressed breathing air. Air is supplied to a demand regulator 22 via a section of flexible hose 24 wich passes beneath the user's left arm. The regulator 22 is connected to a face mask 26. The face mask or face piece 26 is a modified cone-shaped configuration made of a polycarbonate material with a rubber face seal for example. As stated, the present invention is related generally to the back frame 28 for supportably mounting air tank 20 and the pressure regulators associated therewith on a user's back.

Figure 2:
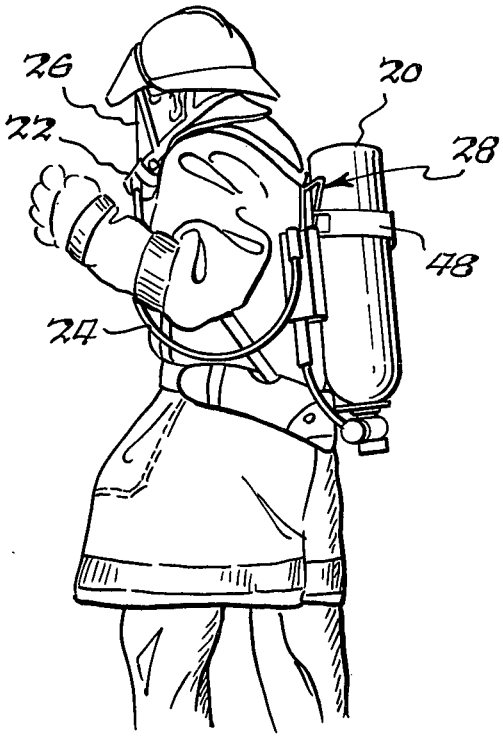
FIG. 2 is a front elevation view of the back frame of the present invention as seen when looking toward the back of a user.
Figures 4, 5:
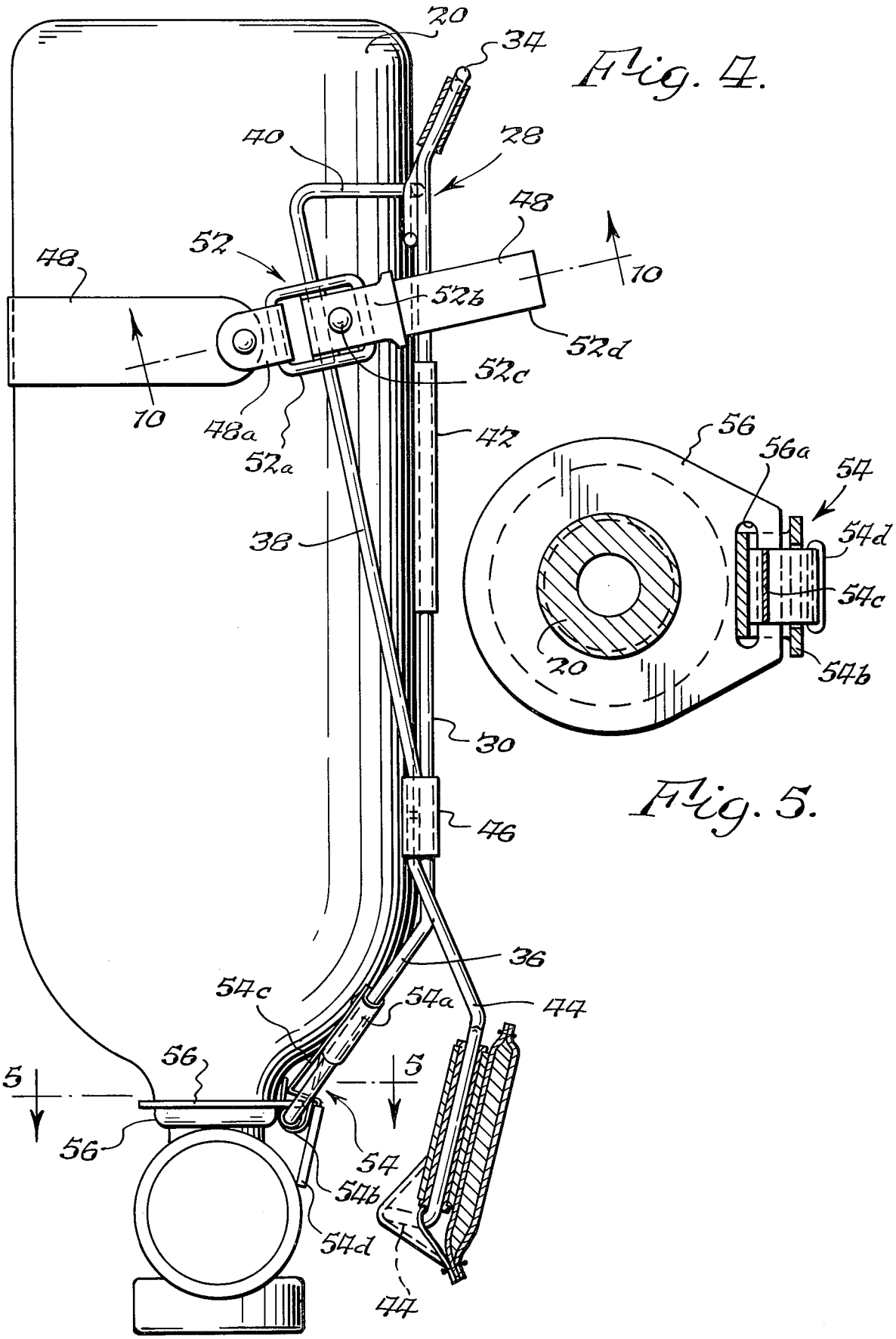
FIG. 4 is a side elevational view of the back frame as including a retaining strap at the upper portion thereof for retaining an air tank in a mounted disposition against the frame.
FIG. 5 is a transverse view partly in section through a neck portion of the air tank as taken about on line 5—5 of FIG. 4.
Figures 6, 7:
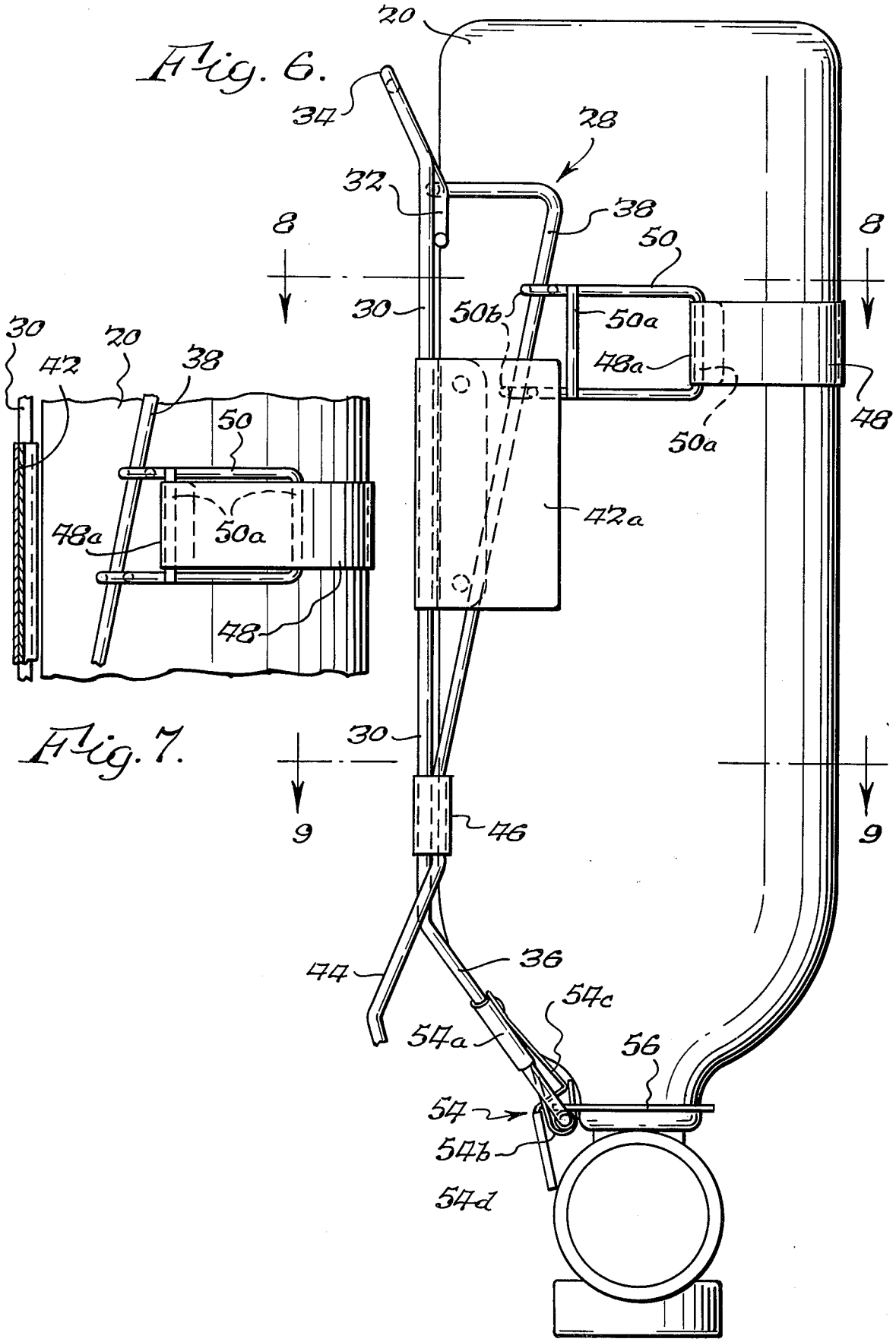
FIG. 6 is a view similar to FIG. 4 illustrating the opposite side of the assembly shown in FIG. 4.
FIG. 7 is an isolated, detailed view in fragmentary form of the stepped bracket connection of the retaining strap to one of the lateral edge rails of the back frame.

Turning now to a consideration of FIG. 2, the back frame 28 includes upstanding metallic rail members 30 which are positioned adjacent to a user's back as are the crossover elements 32 and 34 which interconnect the upper portions of rails 30. The lower portions of rails 30 are connected by a U-shaped rail element 36 which extends outwardly from the plane of rails 30 as seen most clearly in FIGS. 4 and 6. In addition, a pair of inclined rails 38 form lateral edges of the body portion of frame 28. The inclined rails 38 as best viewed in FIGS. 4 and 6 are spaced from a user's back at their upper ends and extend or incline toward a user's back at their lower ends. An interconnecting rail element 40 is provided at the upper ends of rails 38 and is formed to curve outwardly from a user's back so as to receive tank 20 in a cradled manner.

Figure 3:
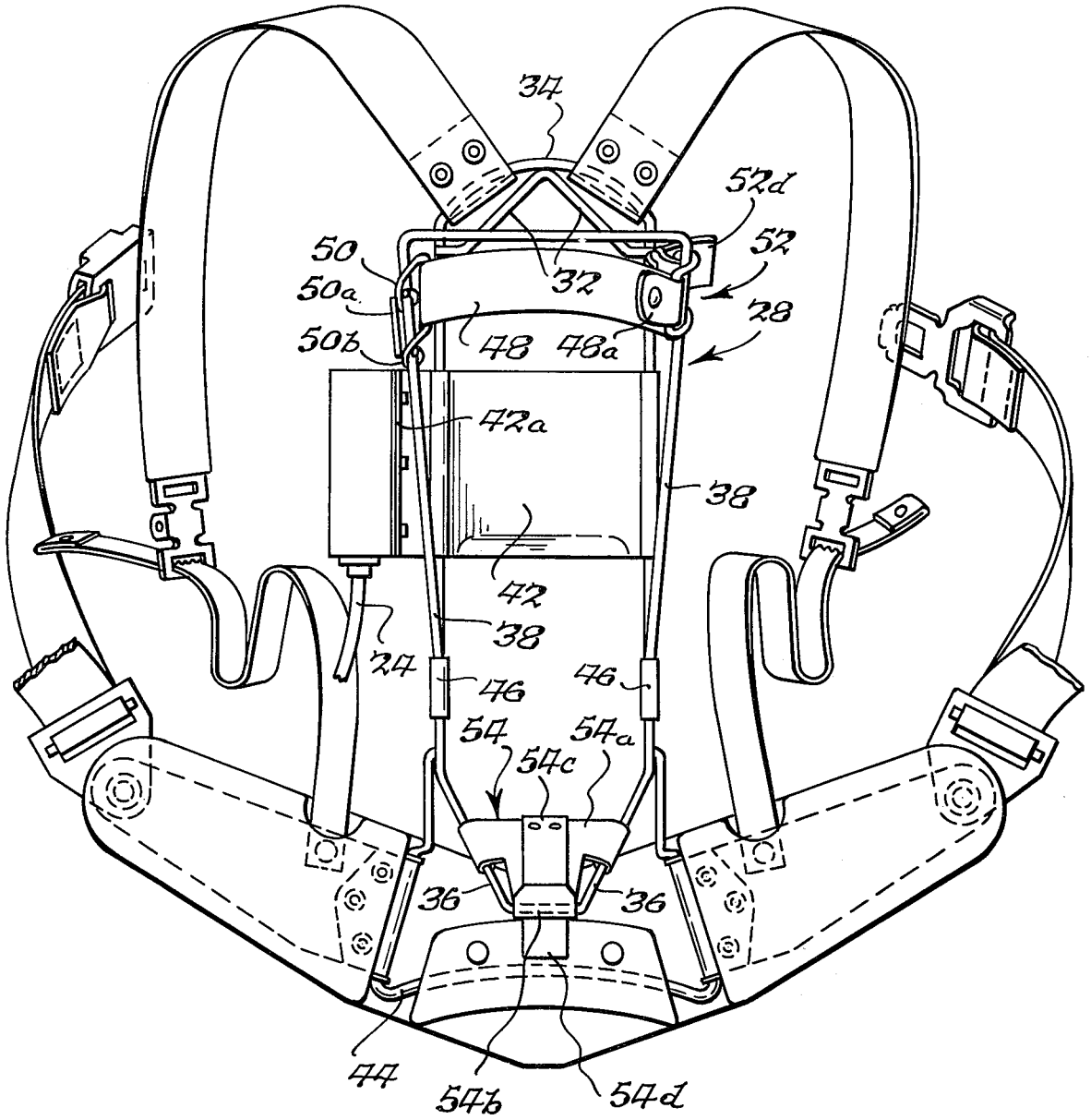
FIG. 3 is a view similar to FIG. 2 showing a harness arrangement attached to the back frame for purposes of securing the same to the back of a user.

A back plate 42 is shown in FIG. 2 for example has also interconnecting rails 30. Plate 42 is relatively flat so as to comfortably fit against a user's back and includes a turned edge 42*a* which provides for the mounting of hose end 24. The lower ends of rails 38 are in turn interconnected by a large U-shaped element 44 which as most clearly seen in FIGS. 2 through 4 provides for the attachment of the lower portion of the harness associated with the back frame. In a similar manner, the crossover bracket 34 provides for connection of the upper portion of the harness to the back frame. The back frame as including the lateral edge rails 38 and rails 30 is of an integral construction by the rigid engagement of correspondingly adjacent rails 30 and 38 together at the joints indicated as 46.

A retaining strap 48 is provided at the upper portions of rails 38. One end of the retaining strap is connected to a rail 38 by a stepped bracket 50. As viewed in FIGS. 6 and 7, the end of retaining strap 48, preferably being of a fire resistant material such as metal, includes a U-shaped end 48*a* for engagement over either of the steps or cross links 50*a*. As is to be further appreciated from a consideration of FIG. 8, the portion of bracket 50 connected to rail 38 includes apertured eye hook type configurations 50*b* which are received over rail 38 in a slidable manner.

Figure 8:
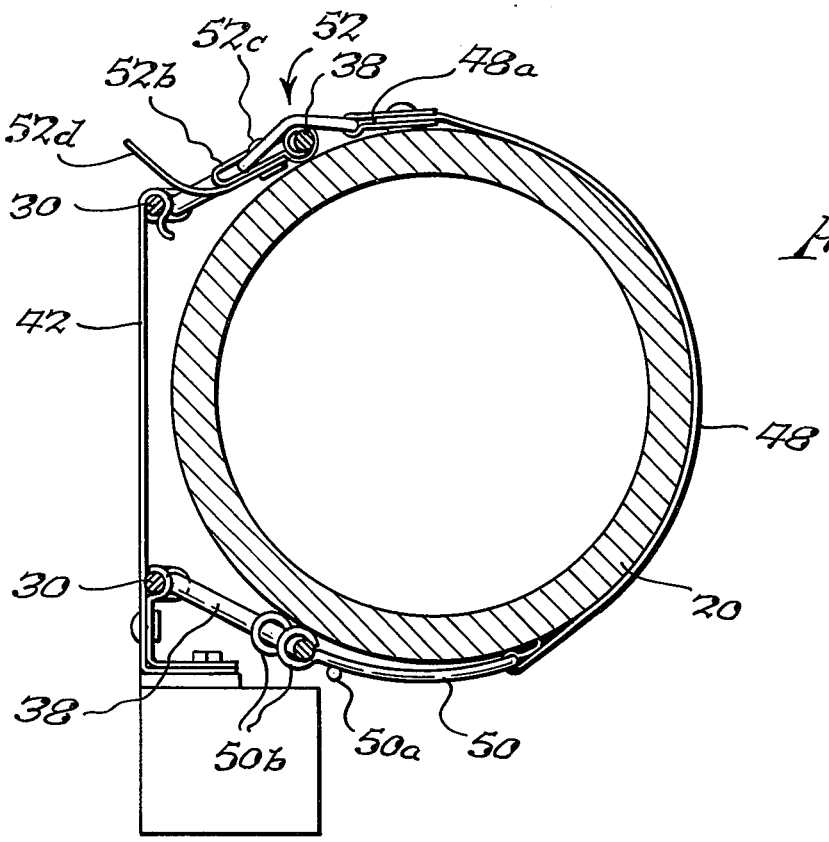
FIG. 8 is a transverse view partly in section of the air tank and retaining strap subassembly as taken about on line 8—8 of FIG. 6.
Figure 9:
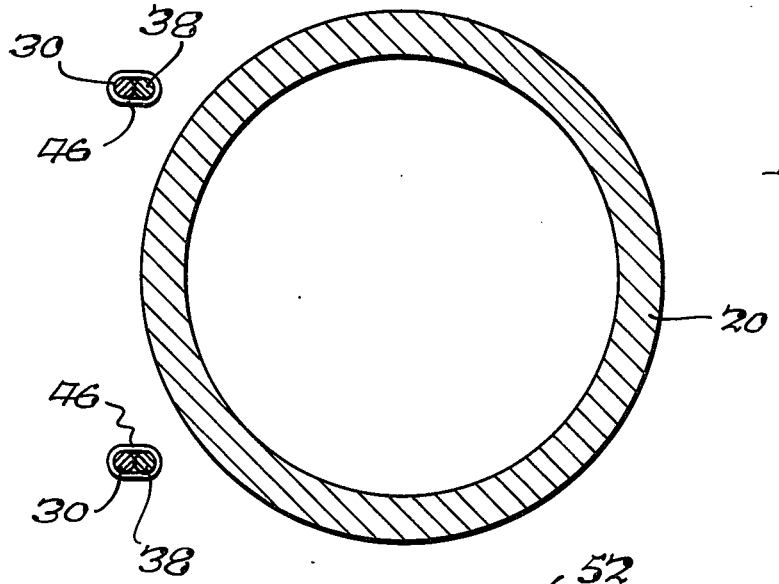
FIG. 9 is a view similar to FIG. 8 showing a transverse view in section of the air tank as taken about on line 9—9 of FIG. 6.
Figure 10:
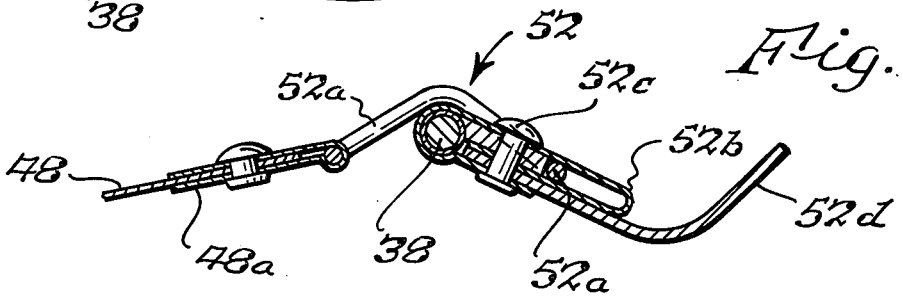
FIG. 10 is an isolated view partly in section of the toggle latching means forming part of the retaining strap as taken about on line 10—10 of FIG. 4.

The other end of retaining strap 48 is conncted to an edge rail 38 by toggle latching means 52. As best seen in FIGS. 4 and 8, the toggle is connected to strap 48 by the pinned U-shaped bracket 48*a*. As is apparent from the detailed illustration of FIG. 10, the wire bracket 52*a* forming part of the toggle may rotate with respect to its mounting in the strap bracket 48*a*. The other end of toggle element 52*a* is received within the pinned toggle clip element 52*b*. Clip 52*b* is of a closed loop construction as clearly shown in FIG. 10 and includes a pin 52*c* extending therethrough isolating the sliding connection of clip 52*b* on edge rail 38 at its left hand end as viewed in FIG. 10 from the sliding fit of toggle element 52*a* in the right hand end of clip 52*b*. In addition, a flexible tab 52*d* is attached to clip 52*b* for facilitating the opening and closing of the toggle.

Turning now to a consideration of the lower end of the back frame as seen in FIGS. 4 through 6, a vertical support bracket generally indicated as 54 is mounted on the crossover rail 36. The vertical support bracket 54 is provided to engage the apertured collar 56 affixed to the neck of tank 20. The support bracket 54 includes a crossover plate 54*a* which spans and is attached to crossover rail 36. An upwardly oriented, U-shaped bracket 54*b* depends from bracket 54*a* and is received through aperture 56*a* in the collar 56. In this manner, the collar 56 and necessarily tank 20 are vertically supported. In addition, bracket 54 includes a cantilevered leaf spring 54*c* which depends downwardly from bracket element 54*a* The leaf spring as viewed in FIG. 4 is biased to the left to engage the adjacent side of the free end of the U-shaped bracket portion 54*b*. In this manner, the apertured collar 56 is vertically locked on the bracket portion 54*b* by the vertical restriction provided by the biased spring 54*c*. However, the extreme lower end of spring 54*c* is provided with a tab portion 54*d* which may be urged to the right in FIG. 4 for purposes of releasing the tank and associated collar 56 when for example the tank is to be replaced or exchanged.

In utilizing the apparatus forming and associated with the present invention, reference is made to FIGS. 4, 6 and 8 for example. Upon initially installing a tank 20 on the back frame, the toggle would be opened by revolving the same in a clockwise direction as viewed in FIG. 8 by grasping the toggle tab 52*d*—as shown in FIG 8 the toggle is closed. Thereafter, the top of the tank would be slid underneath strap 48 and raised vertically therethrough until the tank collar 56 was at a point above the U-shaped support bracket 54*b*. The tank would then be lowered so that aperture 56*a* would drop downwardly against leaf spring 54*c* to urge the latter to the right as viewed in FIG. 4 with the collar 56 bottoming out in bracket 54*b*. Necessarily, the biasing of spring 54*c* would return it to the position shown in FIG. 4 after passage of the collar thereby.

In the tightening strap 48, the end 48*a* thereof would be engaged over one of the connecting links or step elements 50*a* to adjust the effective length of the strap to an appropriate degree corresponding to the diameter of the tank used. It is contemplated for example that air tanks on the order of five to seven inches in diameter will be utilized. Since it is preferred that strap 48 be made of fire resistant material such as metal, the strap will in and of itself not include any significant degree of elasticity. However, the bracket 50 and toggle 52 can be slid along the incline of edge rails 38 to provide precise adjustment to the retention force which will be applied to tank 20 when the toggle is closed. In addition, the rail elements 38 inherently include a certain degree of resiliency so that when the toggle is urged into a closed position as shown in FIG. 8, the adjustements provided by bracket 50 and the positioning of bracket 50 and toggle 52 on rails 38 and the resiliency of rails 38 in and of themselves provide for a firm retention of tank 20 against the cradling crossover element 40 of the frame. With the tank collar 56 securily locked in place and vertically supported by bracket 54*b*, it is ensured that the tank will remain properly mounted. Even if the toggle 52 should be accidentally opened during use of the system, the tank collar 56 would not become disengaged from bracket 54*b* and the tank would still be maintained in a proper orientation on the back of the user, although obviously be subject to shifting due to the relaxed condition of strap 48 under such circumstances.

From the foregoing, it is apparent that the objects of the present invention have been fully accomplished. As a result of this invention, an improved back frame is provided whereby air tanks may be changed quickly and in a manner involving minimum operational risk. The back frame is so formed to accommodate various sizes of air tanks and is contoured so that the center of gravity for a firefighter's breathing system for example is near the user body's natural center of gravity. In addition, the weight of the frame is carried on the hips in the area of crossover rail 44 and the harness portion attached thereto which results in better balance of the load. Necessarily, the user may move over hazardous terrain more safely and with much less fatigue. Furthermore, one of the most important aspects of the present invention is the fact that during extended use, air tanks may be exchanged or replaced quickly and safely without the user having to take off the back frame unit. Necessarily this latter aspect is important with respect to a firefighter's efficiency.

Having thus described and illustrated a preferred embodiment of our invention, it will be understood that such description and illustration is by way of example only and that such modifications and changes as may suggest themselves to those skilled in the art are intended to fall within the scope of the present invention as limited only by the appended claims.

It is claimed

1. An improved back frame for use in a life support breathing system supplying regulated breathing air to a user thereof wherein said system includes a tank of compressed breathing air supported on the back of a user by said back frame, a face mask and regulated air hose means, said latter means being intermediately disposed in fluid connection with said tank of compressed breathing air and said face mask, said improved back frame comprising:

a body portion adapted for placement on the back of a user and harness means for so securing said body portion thereon, and a retaining strap operable to releasably retain said tank of compressed air on the side of said back frame body portion outward of the user's back, each of the ends of said retaining strap being secured to a corresponding lateral edge of said body portion so as to at least partially encircle and engage said tank, at least one of said lateral edges of said body portion being inclined with respect to the longitudinal axis of said tank with the correspondingly associated end of said strap being slidable therealong so as to adjust the retention force applied to said tank by said strap.

2. The apparatus as set forth in claim 1 wherein said strap further includes latching means for loosening and tightening said strap against said tank whereby said tank may be quickly removed from said back frame and replaced.

3. The apparatus as set forth in claim 2 wherein said latching means comprises a toggle latch operable between an open and closed disposition for respectively loosening and tightening said strap with respect to said tank.

4. The apparatus as set forth in claim 1 wherein both lateral edges of said body portion are inclined to substantially the same degree and both ends of said strap are respectively slidable therealong.

5. The apparatus as set forth in claim 4 wherein at least one end of said strap is connected to said corresponding lateral edge of said body portion by a stepped bracket means whereby the length of said strap may be varied so as to be operable with tanks of varying diameters.

6. The apparatus as set forth in claim 5 wherein said strap further includes latching means for loosening and tightening said strap against said tank whereby said tank may be quickly removed from said back rame and replaced.

7. The apparatus as set forth in claim 6 wherein said latching means comprises a toggle latch operable between an open and closed dispositionfor respectively loosening and tightening said strap with respect to said tank.

8. The apparatus as set forth in claim 6 wherein said back frame body portion includes a support means operable with respect to said tank when the latter is placed between said strap and said body portion, for vertically supporting said tank on the user's back.

9. The apparatus as set forth in claim 8 wherein said tank includes an apertured collar and said support means comprises an upwardly oriented, U-shaped bracket whereby the latter is received within said aperture of said tank collar.

10. The apparatus as set forth in claim 9 wherein said support means includes a leaf spring biased to lock said tank collar on said U-shaped bracket whereby said leaf spring may be manually deflected to receive and release said tank collar.

11. The apparatus as set forth in claim 10 wherein both lateral edges of said body portion comprise rail type elements inclined in a manner that the upper portions thereof are spaced relatively away from the user's back and the lower portions thereof extend relatively toward the user's back with said strap being disposed on the upper ends of said lateral edge rails and said support means being disposed on the lower portion of said back frame body portion.

12. The apparatus as set forth in claim 10 wherein said strap, said step bracket means and said latching means are formed of fire resistant material to ensure retention of said tank on said back frame in proper engagement with said support means when used in fire related conditions.

* * * * *